US007096974B2

(12) United States Patent
Obermeier et al.

(10) Patent No.: US 7,096,974 B2
(45) Date of Patent: Aug. 29, 2006

(54) HANDLE FOR A HAND-HELD POWER TOOL

(75) Inventors: Josef Obermeier, Peiting (DE); Thomas Hofbrucker, Mammendorf (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/910,877

(22) Filed: Aug. 4, 2004

(65) Prior Publication Data

US 2005/0042051 A1 Feb. 24, 2005

(30) Foreign Application Priority Data

Aug. 11, 2003 (DE) ..... 103 36 874

(51) Int. Cl.
*E21B 3/00* (2006.01)

(52) U.S. Cl. ..... 173/217; 173/29; 173/170; 173/171

(58) Field of Classification Search ..... 173/170, 173/169, 171, 217, 216, 29
See application file for complete search history.

(56) References Cited

U.S. PATENT DOCUMENTS

| | | | | | |
|---|---|---|---|---|---|
| 1,410,010 | A * | 3/1922 | Goldschmidt | 173/49 |
| 3,352,368 | A * | 11/1967 | Maffey, Jr. | 173/169 |
| 3,571,874 | A * | 3/1971 | Von Arz | 29/81.14 |
| 4,347,450 | A * | 8/1982 | Colligan | 310/50 |
| 4,522,270 | A * | 6/1985 | Kishi | 173/217 |
| 4,977,306 | A * | 12/1990 | Kosaka et al. | 392/380 |
| 5,421,225 | A * | 6/1995 | Chen | 81/490 |
| 5,884,008 | A * | 3/1999 | Goldberg | 392/385 |
| 6,308,599 | B1 * | 10/2001 | Fu-Hui | 81/490 |
| 6,364,033 | B1 * | 4/2002 | Hung et al. | 173/217 |
| 6,467,556 | B1 * | 10/2002 | Alsruhe | 173/217 |
| 6,938,706 | B1 * | 9/2005 | Ng | 173/216 |

* cited by examiner

*Primary Examiner*—Scott A. Smith
(74) *Attorney, Agent, or Firm*—Abelman, Frayne & Schwab

(57) ABSTRACT

A hand-held power tool including a tool spindle (12) having a motor (6) for driving the tool spindle (12), a handle (18) having a forwardly inclined position in which the handle (18), starting from the spindle axis (W) is inclined, at least for a most part, in an operational direction (A) of the power tool (2), and an actuator (22) provided on the handle (18) for switching the motor (6) on and off.

11 Claims, 6 Drawing Sheets

HANDLE FOR A HAND-HELD POWER TOOL

BACKGROUND OF THE INVENTION

1. Field of the Invention

The present invention relates to hand-held power tools such as, e.g., motor-driven screw-driving, drilling, and chisel tools, in particular to drills, hammer drills, rotary-percussion tools, battery-driven screw-driving tools having each a handle, in particular, a pistol grip-shaped handle having an ergonomical curvature and inclined over its longitudinal extent, for the most or completely, with respect to the spindle axis of the power tool, with an actuator for switching the motor on and off being mounted on the handle.

2. Description of the Prior Art

Handles, which are inclined relative to the spindle axis, proved themselves over the years as optimal handles for motor-driven hand-held tools. Mostly, the handles have a shape of a pistol grip. The later has a curvature adapted to a human hand. Such handles can constitute a component of all possible handle shapes such as spade handles, T-handles, or be provided thereon. German Publication DE 33 41 823 discloses a handle of an electrical tool with a pistolet-shaped switch handle. The handle forms with the spindle axis of the tool an angle of about 100° in the operational direction of the tool. As a result, with a conventional work in the direction of a wall, a ceiling, or a floor, the forearm axis and the spindle axis are substantially parallel to each other. The switching of the motor on and off is effected, with a conventional position of the hand on the handle, with the fore-and middle fingers. In addition, there is provided an auxiliary handle, with which at a conventional operation of the tool, the forearm axis and the spindle axis extend substantially coaxially with each other, and the switching of the motor on and off by actuating the actuator is effected with the small and ring fingers.

With the known arrangement of the pistol-shaped switch handle, in the majority of applications, optimal guidance and transmission of force from a tool operator to the tool becomes possible.

A drawback of the known switch handle consists in that with, e.g., working a wall in the vicinity of a floor, in particular, during mounting of skirting boards, the hand of an operator grips the handle in the ergonomically most unfavorable position. This consists in that with such use of the tool, often the handle, together with the handle-holding hand, occupies a position which is directly opposite the position of the handle at normal uses. Moreover, in such cases, the actuation of the actuator is rather difficult as the actuator is not located any more in the region of the fore-and middle fingers but rather in the region of the small-and ring fingers.

Accordingly, an object of the present invention is to eliminate the foregoing drawbacks in hand-held power tools such as screw-driving, drilling, and chisel tools.

Another object of the invention is to provide a hand-held power tool with a handle which would insure a convenient operation of the tool in corner regions between a wall and a floor.

SUMMARY OF THE INVENTION

These and other objects of the present invention, which will become apparent hereinafter, are achieved by providing a handle that has a forwardly inclined position in which the handle, starting from the spindle axis, i.e., in the direction of its longitudinal extent, is inclined, at least for the most part, relative to the spindle axis, in the operational direction of the tool. Thereby, a hand of an operator occupies an ergonomically favorable position in applications, such as working the corner region between a wall and a floor, when the handle is pivoted by 180° with respect to the normal position of the handle during a conventional wall operation of the tool. The power tool is held so that the spindle axis lies beneath the handle and in a position in which it is closest to the small finger of the operator hand holding the handle. With this position, the spindle axis is located closely to the floor or bottom, and the handle is conveniently held by the operator. The convenient holding is achieved as a result of the forearm axis of the operator and the spindle axis of the tool extending parallel to each other when the tool is pivoted about the spindle axis by 180° with respect to its normal position.

In accordance with a preferred embodiment of the present invention, the handle is pivotable between its forwardly inclined position and its normally inclined position in which the handle starting from the spindle axis, is inclined, at least for the most part, in a direction opposite the operational direction of the tool. This permits to use the tool in any desirable application, for normal operation on walls, floors, and ceilings and for operation in corner regions, in particular between a wall and a floor. In this way, the operator's hand always occupies an ergonomically optimal position in each possible application.

Advantageously, the balancing axis of the handle forms an angle in a range from 10° to 40°, in particular, an angle of 30°, between the forwardly inclined position and the normally inclined position of the handle. The balancing axis is an axis that passes through the centers of cross-sectional surfaces of the handle at opposite ends of the finger seat. Pivoting of the balancing axis in the range from 10° to 40° insures obtaining an ergonomically optimal holding of the tool handle in both pivotal positions of the handle. The angle of 30° proved to be particularly advantageous as it insures an ergonomically favorable aligning of the handle in both pivotal positions.

Advantageously, an angle between the balancing axis in any one of the forwardly inclined positions of the handle and the normally inclined position of the handle and a perpendicular to the spindle axis amounts from 10° to 20°, preferably, to 15°. The inclination in the range from 10° to 20° provides an ergonomically optimal position of a to-be-held handle. An inclination of 15° provides for a handle-holding position of an operator hand on the handle that comes closest to the natural position of the hand-forearm position.

Advantageously, the handle can be secured with respect to the spindle axis, e.g., with appropriate locking means, in a plurality of positions. This permits to adapt the alignment of the handle, in comparison with conventional tools, to particular requirements and all possible applications.

Further, the actuator for switching the motor on and off extends advantageously along a longitudinal extent of the handle, passing through the center of the finger seat. The finger seat is defined as a bearing region for the small, ring, middle, and forefingers which is provided on the handle. As a rule, the finger seat is formed by a trough-shaped mold provided on a side of the handle facing in the operational direction of the tool. Thereby, in each contemplated holding position of the hand, it is insured that the actuator can be conveniently actuated by a finger lying on the finger seat.

It is particularly favorable when the actuator extends over a major portion of the finger seat, which insures that in each possible holding position of the holding hand, an adequate pressure is applied by fingers for actuating the actuator.

According to a particular advantageous embodiment, the actuator is displaceable along the longitudinal extent of the handle, can be pushed therealong, whereby the position of the actuator can be adapted, in each position of the handle, in comparison with conventional tools, to a holding position of the holding hand.

Advantageously, the actuator has at least two fixed positions on the handle. Thereby, in both the forwardly inclined position and the normally inclined position, a particularly favorable position of the actuator can be predetermined by a corresponding arrangement of locking means. Then, the actuator is fixed in the predetermined position.

Advantageously, the actuator is provided at each of its opposite, in the displacement direction, ends, with a cover element for covering a guide formed in the handle. Such cover elements can be formed by aprons or tabs that project at the ends of the actuator away from the handle. The cover elements are formed of a flexible material or are pivotally supported on the actuator. The cover elements prevent penetration of dirt in the guide of the actuator, which can lead to malfunction.

Advantageously, the actuator can be formed as a tumbler switch that forms, at its two opposite ends, together with the handle respective pivot devices which operate in such a way that when one of two pivot devices is actuated, the other pivot device is simultaneously deactivated. Such a tumbler switch can be easily actuated by applying pressure to the pivot point remote from the actuated pivot point.

Alternatively, the actuator can be formed as a rocker switch. Thereby in each holding position of the holding hand on the handle, the actuator is easily actuated by applying pressure to one of its opposite ends.

The novel features of the present invention, which are considered as characteristics for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENTS

Figure 1:
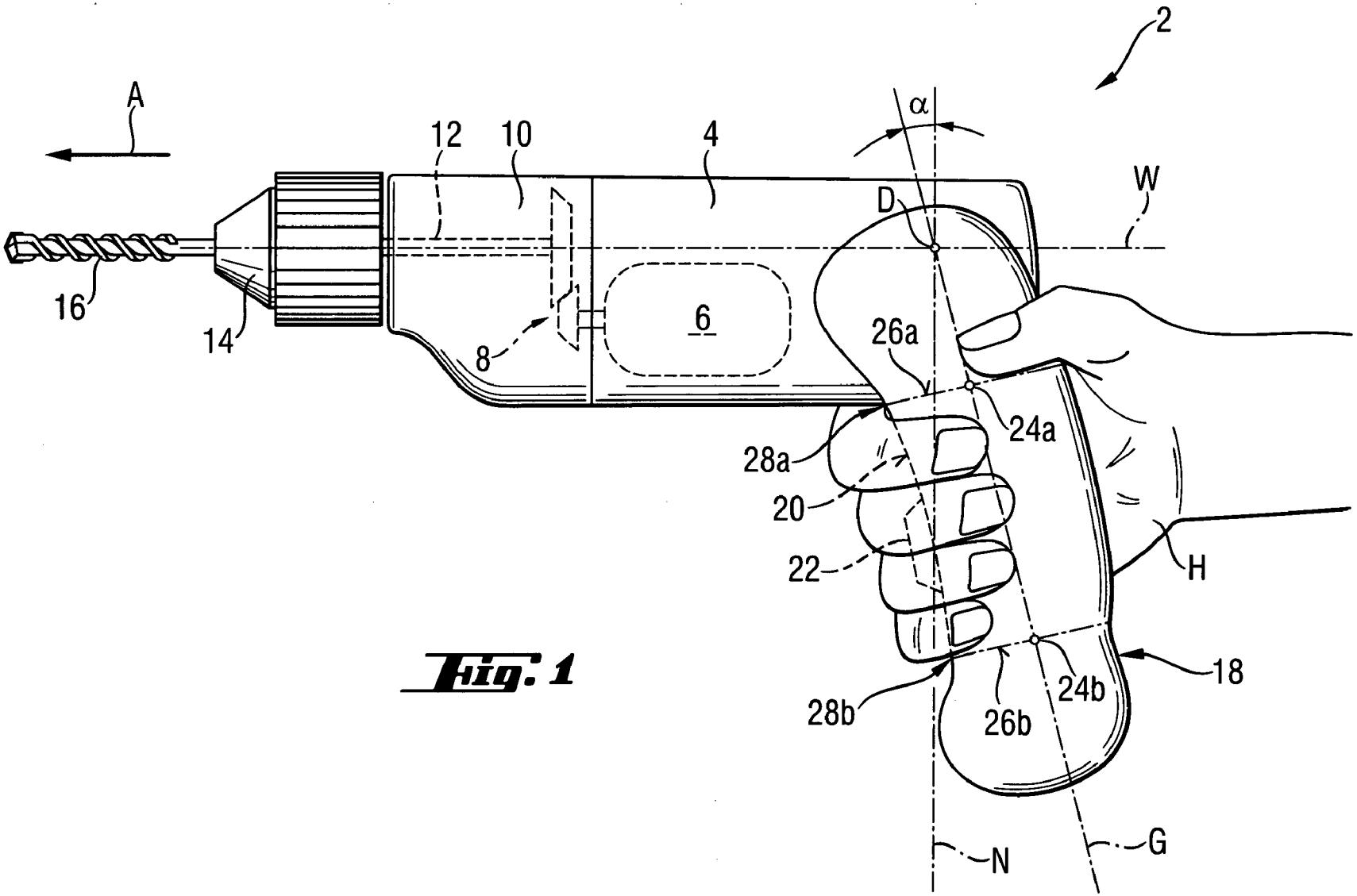
FIG. 1 a side view of a hand-held power tool with a handle according to the present invention in a normally inclined position.

A power hand-held tool 2, which is shown in FIG. 1, has a combined drilling and screw-driving function and includes essentially a motor unit 4 with a motor 6 shown with dash lines. A schematically shown gear unit 10 with a gear transmission 8 connects the motor 6 with a tool spindle 12 likewise shown with dash lines. At the front, facing in the operational direction A of the power tool 2, end of the spindle 12, there is provided a chuck 14 in which a working tool 16 is received. The tool spindle 12 has a spindle axis W.

At the rear, with respect to the operational direction A, end of the motor unit 4, there is provided a handle 18 having a shape of a pistol grip, i.e., it is provided with an ergonomically favorable curvature. The handle 18 is held with a human hand H, with the small, ring, middle, and forefinger engaging or gripping a finger seat 20. The finger seat 20 is provided on a side of the handle 18 facing in the operational direction A and is formed by a bottom of a trough-shaped mold. On the finger seat 20, there is provided an actuator 22 which extends longitudinally in the central region of the seat 20 and is connected with the motor 6.

The handle 18 pivots about a pivot axle D on which the motor unit 4 is held. A balancing axis G forms, in a normal position of the handle 18 shown in FIG. 1, a differential angle $\alpha$ of 15° with a perpendicular N to the spindle axis W. The balancing axis G extends through centers 24*a*, 24*b* of the transverse surfaces 26*a*, 26*b* at two opposite ends 28*a*, 28*b* of the finger seat 20. In this way, the balancing axis for the handle 18 is inclined, starting from the spindle axis W and to the free end of the handle 18, in a direction away from the operational direction A.

Figure 2:
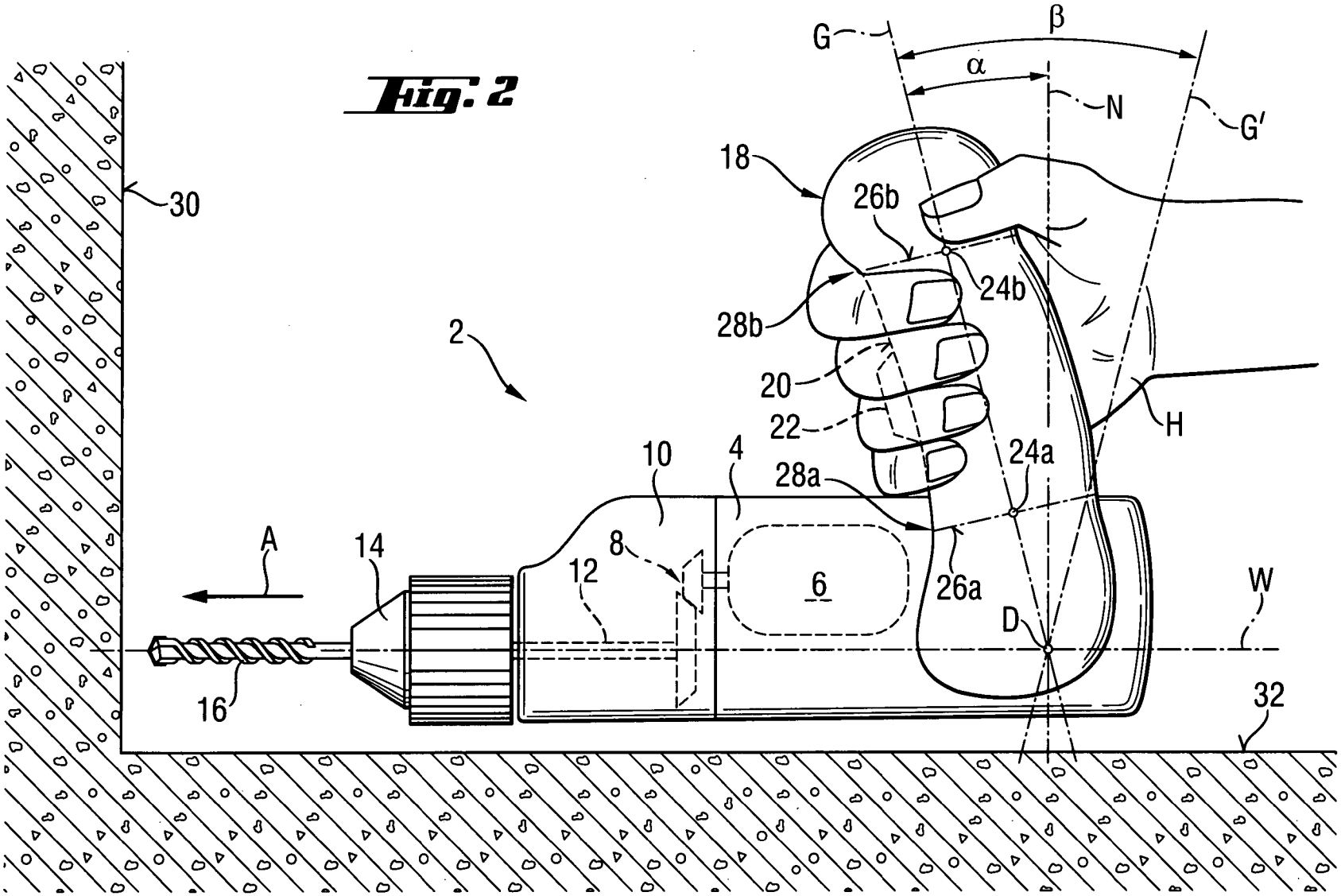
FIG. 2 a side view of the hand-held tool shown in FIG. 1 with the handle in a forwardly inclined position.

FIG. 2 shows the hand-held tool 2 pivoted about the spindle axis W, with respect to the position shown in FIG. 1, by 180°, with the handle 18 being pivoted by an angle $\beta$ of 30° in the operational direction A. To clearly show the pivot position of the handle 18, angle $\beta$, the balancing axis of the normal position is designated with a reference character $G^1$. In the position shown in FIG. 2, the handle 18 or its balancing axis $\beta$ is inclined, with its free end, in the operational direction A. The differential angle $\alpha$ between the balancing axis $\beta$ and the perpendicular N to the spindle axis W again amounts to 15° in the forwardly inclined position of the handle 18.

Based on ergonomical consideration, the differential angle $\alpha$ of 15° was found to be most favorable. However, in accordance with individual preferences or for adaptation to the available space conditions, the differential angle $\alpha$ can vary from 10° to 20°. Moreover, together with a particularly favorable pivot angle $\beta$ of 30° between the normally inclined and forwardly inclined position of the handle 18, in accordance with individual preferences and outside conditions, the pivot angle $\beta$ can vary between 10° and 40°.

With the forwardly inclined position of the handle 18, it is possible to use the hand-held tool 2 for conducting work deep in angular region between the wall 30 and the bottom 32, with conveniently holding the handle 18 with the hand H. In addition, due to the central arrangement of the actuator 22, a convenient switching of the motor 6 on and off is possible.

Figure 3:
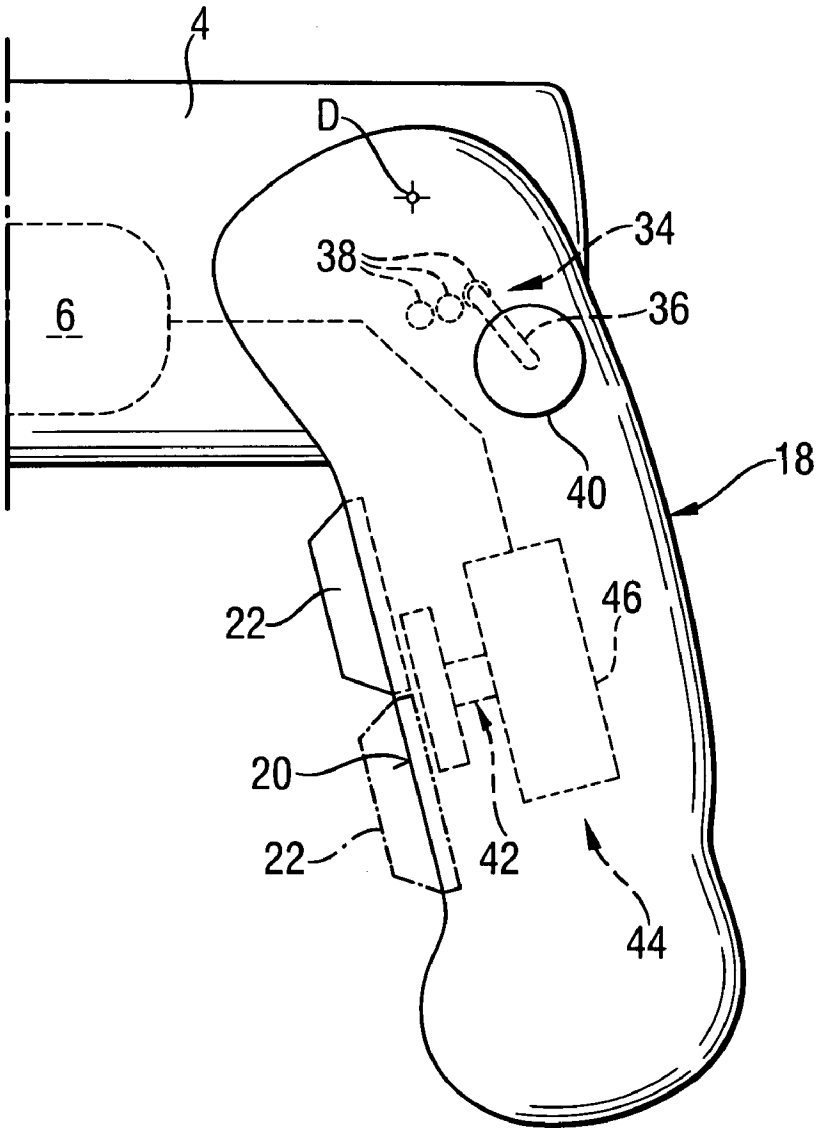
FIG. 3 a side view of the handle with a switching arrangement and a displaceable actuator.

FIG. 3 shows a locking device 34 with a locking element 36 provided on the handle 18 and shown with dash lines. The locking element 36 is immovable in the plane of the drawing but is movable transverse to the plane of the drawings. The locking element 36 is engageable in a plurality of matching locking elements 38 provided in the motor unit 4. By applying pressure to a lock switch 40, which is provided on the handle 18, a locking connection between the locking element 36 and a respective locking element 38 can be released, so that the handle 18 can be pivoted relative to the motor unit 4 into a new position in which the locking element 36 engages in a new matching locking element 38. It is possible to provide a different, from three, number of locking position by providing a different number of matching locking elements 38. It should be noted that different, from the locking device 34, locking devices can be used for locking the handle 18 relative to the motor unit 4.

The actuator 22, which is shown in FIG. 3, is formed as a press-button displaceable in a longitudinal direction of the handle 18 at least in two positions. The upper position of the actuator 22 in FIG. 3 is provided for the normally inclined position of the handle 18, whereas the inner position, shown with dash-dot lines, is provided for the forwardly inclined position of the handle 18. In both positions of the hand H on the handle 18 shown in FIGS. 1 and 2, depressing of the actuator 22 with the force and middle fingers can be conveniently effected.

In both positions, the actuator 22 lies on a tappet 42 of a switch 4. When pressure is applied to the actuator 22, it applies pressure to the tappet 42 displaceable in the switch enclosure 46 fixedly secured on the handle 18. Dependent on how far the tappet 42 projects into the switch enclosure 46, actuation of the motor 6 takes place.

Figure 5:
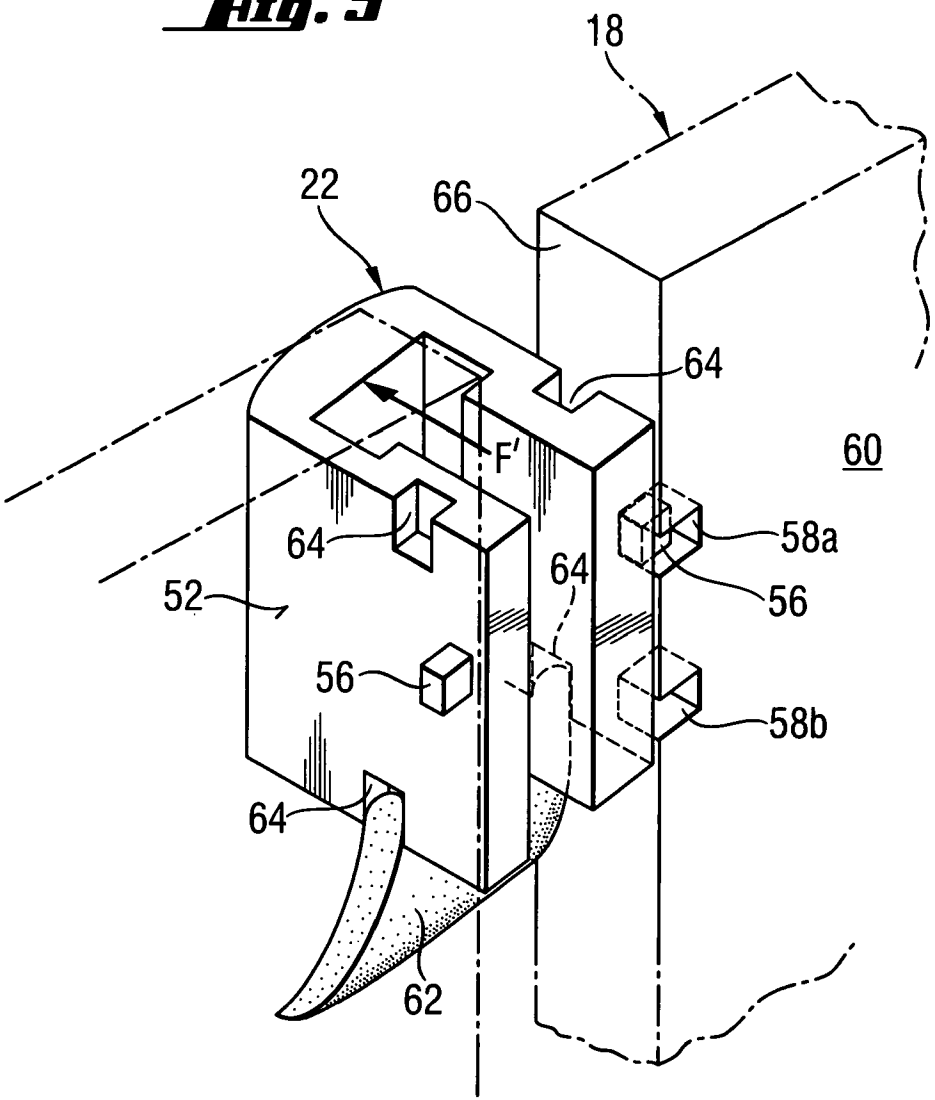
FIG. 5 a perspective view of another embodiment of a displaceable actuator with a partially shown handle.
Figure 4:
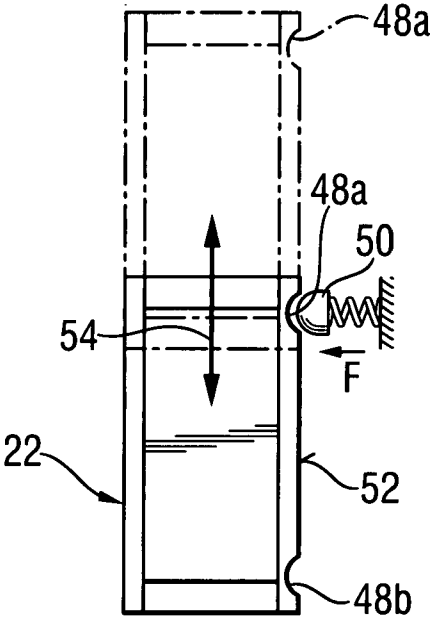
FIG. 4 a top view of the upper side of the displaceable actuator with a locking device.

As shown in FIG. 4, for a reliable locking of the actuator 22, in both positions, on the handle 18, there are provided two locking recesses 48*a*, 48*b* in which a locking nose 50 can engage. The locking nose 50 is also held on the handle 18 and is spring-biased with a biasing force F against a side wall 52 of the actuator 22. Upon displacement of the actuator 22 along the displacement direction 54 relative to the locking nose 50, the locking nose 50 engages in the locking recess 48*a* in the first locking position of the actuator 22 shown with dot-dash lines or in the locking recess 48*b* in the second locking position of the actuator 22 shown with solid lines. In addition to the locking recesses 48*a*, 48*b*, further recesses and, thus, further locking positions of the actuator 22 can be provided. FIG. 5 shows another possibility of changing of locking positions of the actuator 22 on the handle 18. For more clarity, only a portion of the handle 18 is shown. There is provided, on the actuator 22, a plurality of engaging elements 56 spaced from a side wall 52 of the actuator 22 and engaging in respective predetermined locking positions in respective complementary engageable recesses 58*a*, 58*b* formed in the handle 18. For releasing the actuator 22 from its locking position, the actuator 22 is pressed against a biasing force $F^1$ in a direction toward an inner side 60 of the handle 18. The locking element 56 disengages from the respective recess 58*a*, and the actuator 22 can be displaced until the locking element 56 reaches the other engageable recess 58*b*. Upon release of pressure applied to the actuator 22, it would be displaced by the biasing force $F^1$ away from the inner side 60 of the handle 18, with the locking element 56 engaging in the next recess 58*b*.

There are further provided cover elements 62 formed as rubber tabs displaceably arranged in elongated recesses 64 in the actuator 22 for covering a guide recess 66. The cover elements 62 serve for covering, in each position of the actuator 22, a section of the guide recess 66 which is not covered by the actuator 66 itself and through which different contaminants can penetrate into the interior of the handle, which can lead to malfunction. For the sake of clarity, in FIG. 5, only the cover element 62 at the lower end of the actuator 22 is shown. A corresponding cover element 62, not shown, is also inserted in an elongated recess 64 at the upper end of the actuator 22.

Figure 6:
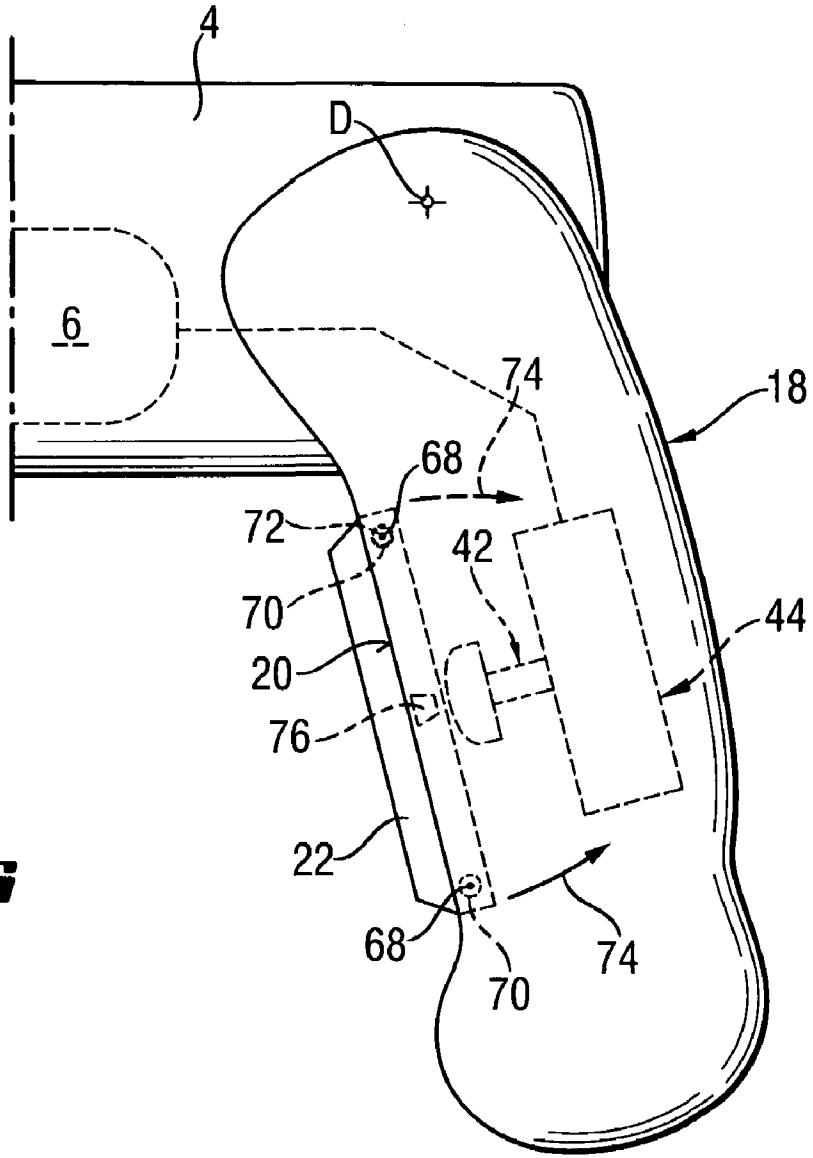
FIG. 6 a side view of a handle with a tumbler switch.

FIG. 6 shows an embodiment in which the actuator 22 is formed as a tumbler switch. The actuator 22 extends, in this embodiment, almost over the entire length of the finger seat 20 and is provided at its opposite ends with a respective pivot device 68. The pivot device 68 can be formed, e.g., by a bore 70 formed in the actuator 22 through which a pin 72 can extend which is fixedly secured on the handle 18. Dependent on which tilting direction is required or desired, one or both of the pivot devices 68 can be actuated, with the corresponding pin 72 extending through the bore 70. Simultaneously, the other three-point device is deactivated by withdrawing a pin 72 from the bore 70.

With a pressure being applied to the actuator 22, the actuator 22 tilts in the tilting direction 74 about the pin 72 of the actuated pivot device 68 and applies pressure to the tappet 42 of the switch 44. There is provided in the center of the actuator 22 a guide element 76 that cooperates with a guide, not shown, formed in the handle 18, providing for reliable axial guidance in both tilting directions 74.

Figure 7:
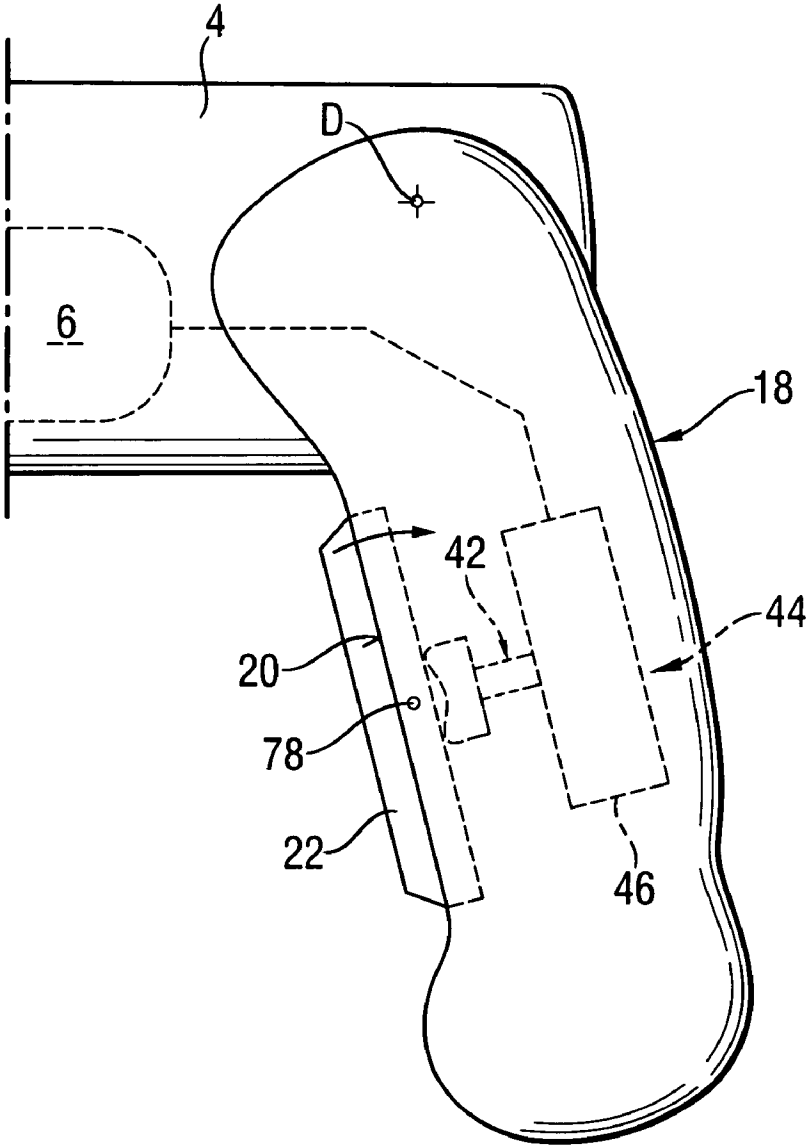
FIG. 7 a side view of a handle with a rocker switch.

A further embodiment of an actuator 22 is shown in FIG. 7. In this embodiment likewise, the actuator 22 extends over the entire length of the finger seat 20 and can be actuated by application of pressure to its opposite ends. The actuator is supported on the handle 18 by an axle 78. The tappet 42 of the switch 44 is so formed that upon application of pressure to any of opposite ends of the actuator 22, it displaces in the switch enclosure 46.

Though the present invention was shown and described with references to the preferred embodiments, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. A hand-held power tool (2), comprising a tool spindle (12) having a spindle axis (W); a motor (6) for driving the tool spindle (12); a handle (18) pivotable between a first holding, forwardly inclined position in which the handle (18), starting from the spindle axis (W), is inclined in an operational direction (A) of the power tool (2) and a second holding, normally inclined position in which the handle (18), starting from the spindle axis (W), is inclined in a direction opposite the operational direction (A) of the power tool; and an actuator (22) provided on the handle (18) for switching the motor (6) on and off, wherein the handle (18) has a balancing axis (G), and wherein an angle (β) between the balancing axis (G) in the forwardly inclined position of the handle (18) and the balancing axis (G) in the normally inclined position of the handle (18) amounts to from 10° to 40°, and wherein an angle (α) between the balancing axis (G) and a perpendicular (N) to the spindle axis (W) varies from 10° to 20° for the forwardly inclined position of the handle (18) and for the normally inclined position of the handle (18).

2. A hand-held power tool according to claim 1, wherein the angle (β) between the balancing axis (G) in the forwardly inclined position of the handle (18) and the balancing axis (G) in the normally inclined position of the handle (18) amounts to 30°.

3. A hand-held power tool according to claim 1, further comprising means for locking the handle (18) in a plurality of inclined positions relative to the spindle axis (W).

4. A hand-held power tool according to claim 1, wherein the actuator (22) extends along a longitudinal extension of the handle (18), passing through a center of a finger seat (20) on the handle (18).

5. A hand-held power tool according to claim 4, wherein the actuator (22) extends over a major portion of the finger seat (20).

6. A hand-held power tool according to claim 1, wherein the actuator (22) is displaceable along a longitudinal extension of the handle (18).

7. A hand-held power tool according to claim 6, wherein the actuator (22) has at least two fixed positions on the handle (18).

8. A hand-held power tool according to claim 6, where in each of opposite, in a displacement directions ends of the actuator (22), there is provided a cover element (62) for covering a guide recess (66) formed in the handle (18).

9. A hand-held power tool according to claim 1, wherein the actuator (22) is formed as a tumbler switch that forms, at two opposite ends thereof, together with the handle (18), respective pivot devices (68), and wherein when one of two pivot devices (68) is actuated, another one pivot device (68) is deactuated simultaneously.

10. A hand-held power tool according to claim 1, wherein the actuator (22) is formed as a rocker switch.

11. A hand-held power tool according to claim 1, wherein an angle ($\alpha$) between the balancing axis (G) and the perpendicular (N) to the spindle axis (W) amounts to 15° for the forwardly inclined position and for the normally inclined positions.

* * * * *